US008746677B2

(12) United States Patent
Ramos et al.

(10) Patent No.: US 8,746,677 B2
(45) Date of Patent: Jun. 10, 2014

(54) MOVING PRINT MEDIA IN A PRINTER

(75) Inventors: Juan D Ramos, Vancouver, WA (US); Kieran B Kelly, Vancouver, WA (US); Keith Jariabka, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 757 days.

(21) Appl. No.: 12/817,385

(22) Filed: Jun. 17, 2010

(65) Prior Publication Data

US 2011/0310156 A1 Dec. 22, 2011

(51) Int. Cl.
*B65H 3/06* (2006.01)

(52) U.S. Cl.
USPC ..... 271/117; 271/109

(58) Field of Classification Search
USPC ..... 271/109, 114, 116, 117
See application file for complete search history.

(56) References Cited

U.S. PATENT DOCUMENTS 2,652,248 A * 9/1953 Johnson ..... 271/116
3,525,517 A * 8/1970 Toby ..... 271/117
4,030,413 A * 6/1977 Young ..... 101/232
5,848,786 A * 12/1998 Holland-Letz et al. ..... 271/110
5,938,189 A * 8/1999 Holland-Letz et al. ..... 271/152
7,198,263 B2 * 4/2007 Acton ..... 271/9.05
2007/0120314 A1 * 5/2007 Koga ..... 271/10.11
2009/0096152 A1 * 4/2009 Lo et al. ..... 271/4.1

FOREIGN PATENT DOCUMENTS

DE 4124566 C * 7/1992

* cited by examiner

*Primary Examiner* — Stefanos Karmis
*Assistant Examiner* — Ernesto Suarez
(74) *Attorney, Agent, or Firm* — Steven R. Ormiston

(57) ABSTRACT

In one embodiment, a device for moving print media in a printer includes: a rotatable shaft extending lengthwise along an axis of rotation and a hub. The hub is operatively and pivotally connected to the shaft at a connection such that the hub rotates with the shaft about the axis of rotation and so that the hub may tilt on the shaft relative to the axis of rotation. The device also includes a pick tire or other feature on the hub on each side of the connection to move print media when the shaft rotates the hub. In another embodiment, a method for moving print media in a printer includes: applying a force to a sheet of print media at two locations spaced apart across the sheet; and, simultaneously with the act of applying, equalizing the force applied at the two locations.

14 Claims, 11 Drawing Sheets

MOVING PRINT MEDIA IN A PRINTER

BACKGROUND

Reliably feeding different sizes of paper and other print media straight into the printer presents significant design challenges in an inexpensive printer. In one conventional technique for feeding print media into the printer, a movable width adjuster is used to register and guide different size media along a stationary registration wall and a single pick tire is placed close to the registration wall to pick and feed media sizes from 3"×5" to A4 and letter size. Although this technique is inexpensive, additional guidance and skew control is needed to get all media sizes straight in the print zone because the pick tire is asymmetric to most media sizes. A second conventional technique uses movable guides in the input tray to position the print media at the center of the tray with one or more pick tires placed symmetrically about the tray centerline. This techniques works well for feeding media straight into the printer but it is more expensive than the edge justified technique and it requires sensors or other edge detectors to avoid unacceptable variations in printed margins.

BRIEF DESCRIPTION OF THE DRAWINGS

In FIG. 12, the hub is straight relative to the axis of rotation of the drive shaft. In FIG. 13, the hub is tilted relative to the axis of rotation of the drive shaft.

The same numbers are used throughout the figures to designate the same or similar parts.

DESCRIPTION

The example drive shaft and hub assembly shown in the figures and described below was developed for an inexpensive printer in an effort to help reliably feed different sizes of paper and other print media straight into the printer. The example embodiment described below should not be construed to limit the scope of this disclosure, which is defined in the claims that follow the description.

Figure 1:
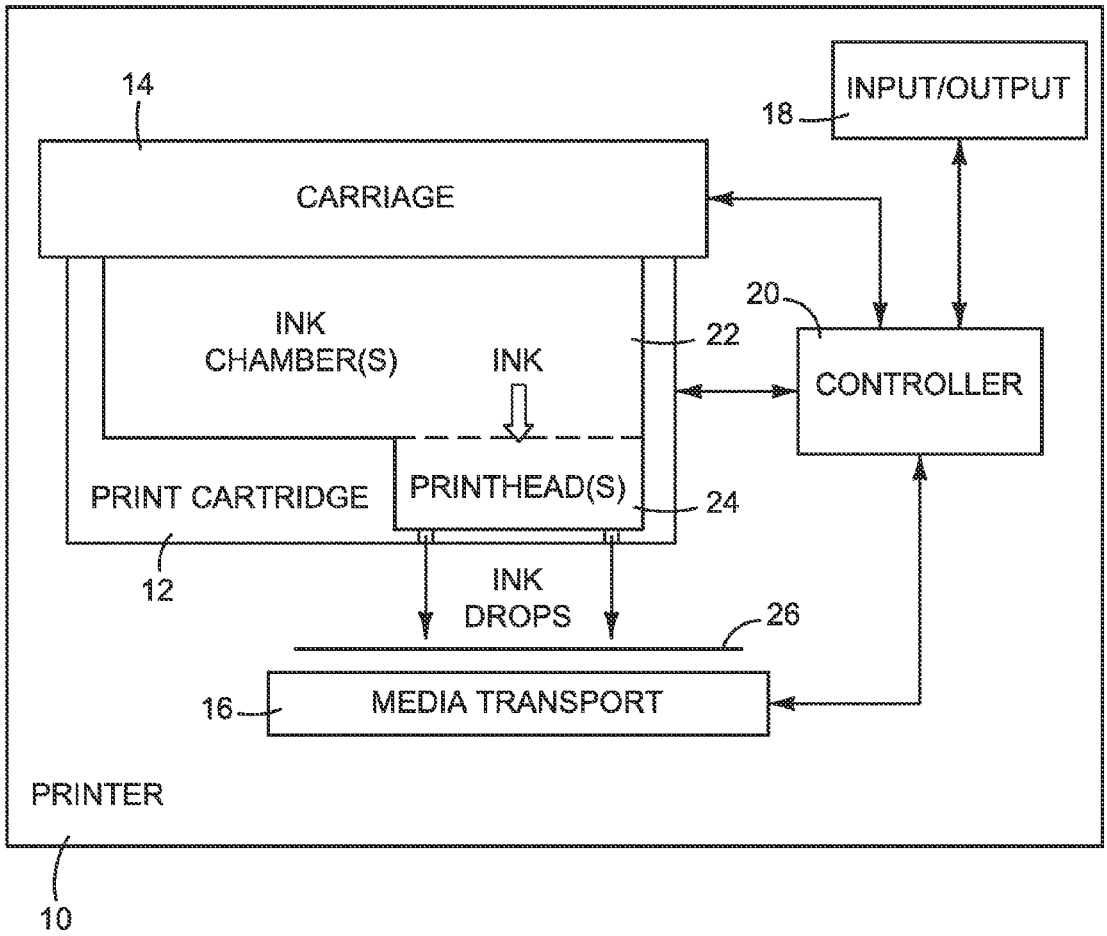
FIG. 1 is a block diagram illustrating one example of an inkjet printer in which embodiments of the present disclosure may be implemented.

FIG. 1 is a block diagram illustrating one example of an inkjet printer in which embodiments of the present disclosure may be implemented. Referring to FIG. 1, printer 10 includes a print cartridge 12, a carriage 14, a print media transport mechanism 16, an input/output device 18, and a printer controller 20 connected to each of the operative components of printer 10. Print cartridge 12 includes one or more ink holding chambers 22 and one or more printheads 24. A print cartridge is sometimes also referred to as an ink pen or an ink cartridge. Printhead 24 represents generally a small electromechanical part that contains an array of miniature thermal resistors or piezoelectric devices that are energized to eject small droplets of ink out of an associated array of nozzles. A typical thermal inkjet printhead, for example, includes a nozzle plate arrayed with ink ejection nozzles and firing resistors formed on an integrated circuit chip. Each printhead is electrically connected to printer controller 20 through external electrical contacts. In operation, printer controller 20 selectively energizes the firing resistors through the electrical contacts to eject a drop of ink through a nozzle on to media 22.

Print cartridge 12 may include a series of stationary cartridges or printheads that span the width of print media 26. Alternatively, cartridge 12 may include one or more cartridges that scan back and forth on carriage 14 across the width of media 26. Other cartridge or printhead configurations are possible. Media transport 16 advances print media 26 lengthwise past cartridge 12 and printhead 24. For a stationary cartridge 12, media transport 16 may advance media 26 continuously past printhead 12. For a scanning cartridge 12, media transport 16 may advance media 26 incrementally past printhead 24, stopping as each swath is printed and then advancing media 26 for printing the next swath. Controller 20 may communicate with external devices through input/output device 18, including receiving print jobs from a computer or other host device. Controller 20 controls the movement of carriage 14 and media transport 16. By coordinating the relative position of cartridge 12 and printhead 24 with media 26 and the ejection of ink drops, controller 20 produces the desired image on media 26.

Figure 2:
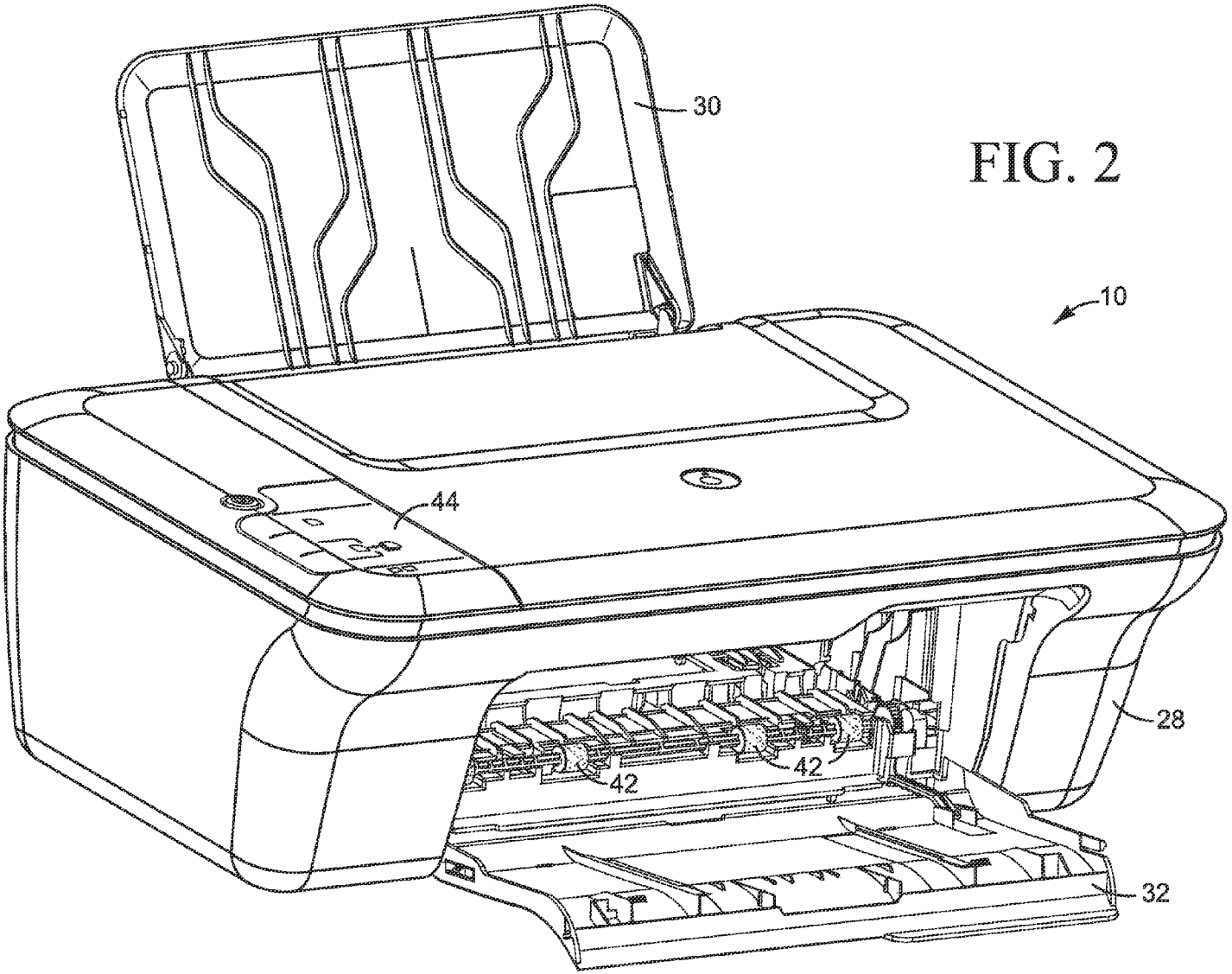
FIG. 2 is a perspective view illustrating an inkjet printer according to one embodiment of the disclosure.
Figure 3:
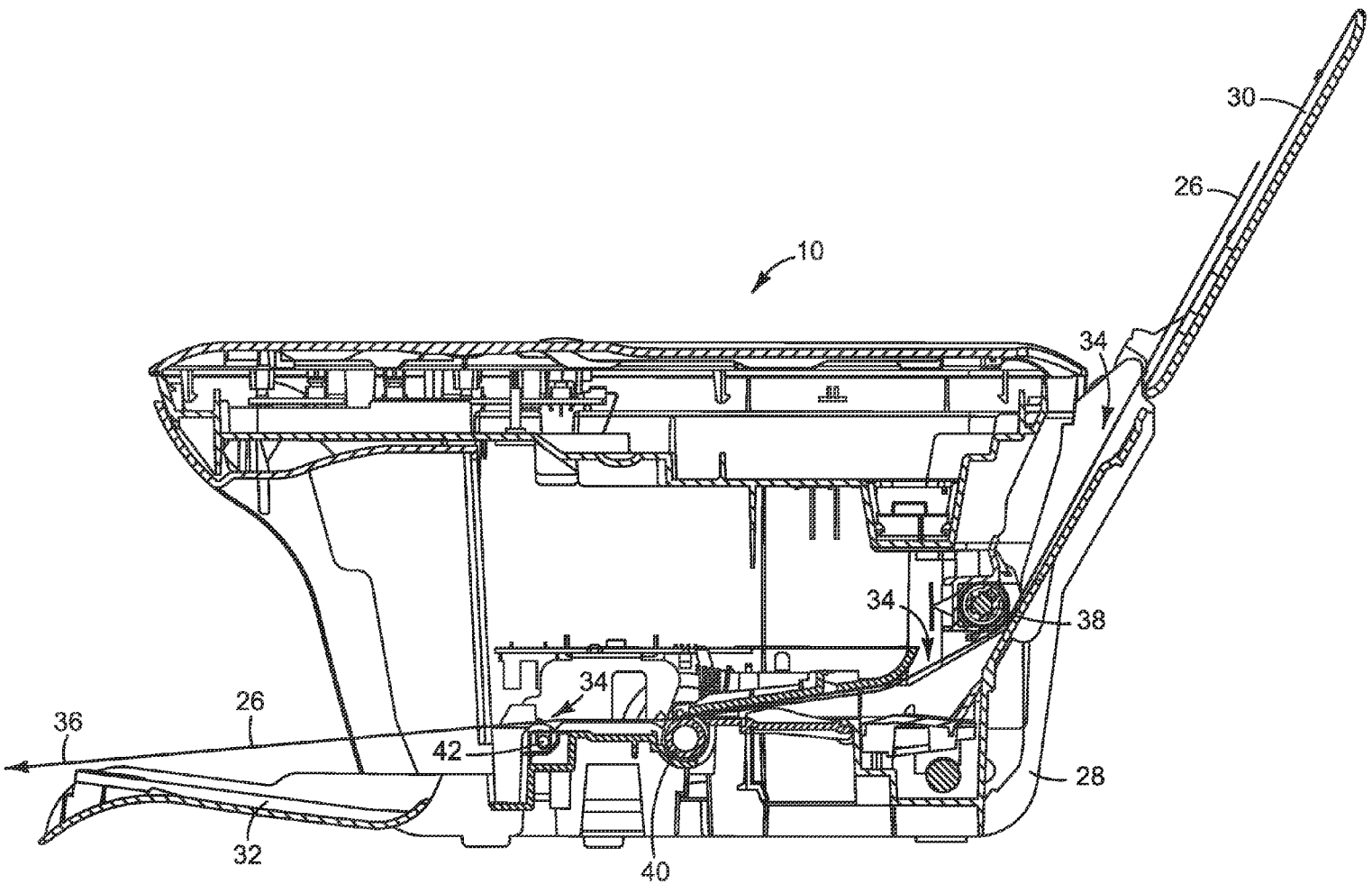
FIG. 3 is a section view of the printer shown in FIG. 2.

FIG. 2 is a perspective view illustrating an inkjet printer 10 according to one embodiment of the disclosure. FIG. 3 is a section view of the printer 10 shown in FIG. 2. Referring to FIGS. 2 and 3, printer 10 includes an external housing 28, an input tray 30 for holding a sheet or stack of sheets of paper or other print media, and an output tray 32 for holding printed media. For an inexpensive printer, such as printer 10, the most common print media is paper. Thus, for convenience, reference is made to paper throughout the remainder of this description. As best seen in FIG. 3, a paper path 34 extends from input tray 30 to output tray 32. FIG. 3 shows a sheet of paper 26 moved along path 34, as indicated by direction arrow 36, at the urging of input rollers 38, intermediate transport rollers 40, and output rollers 42. (Only one roller in each set of rollers 38, 40, and 42 is visible in FIG. 3.) Printer 10 also includes a user control panel 44, a print engine (not shown) and a controller (not shown) housed in housing 30. A print engine for printer 10 may include, for example, a set of print cartridges 12 and a carriage 14 from FIG. 1.

Figure 4:
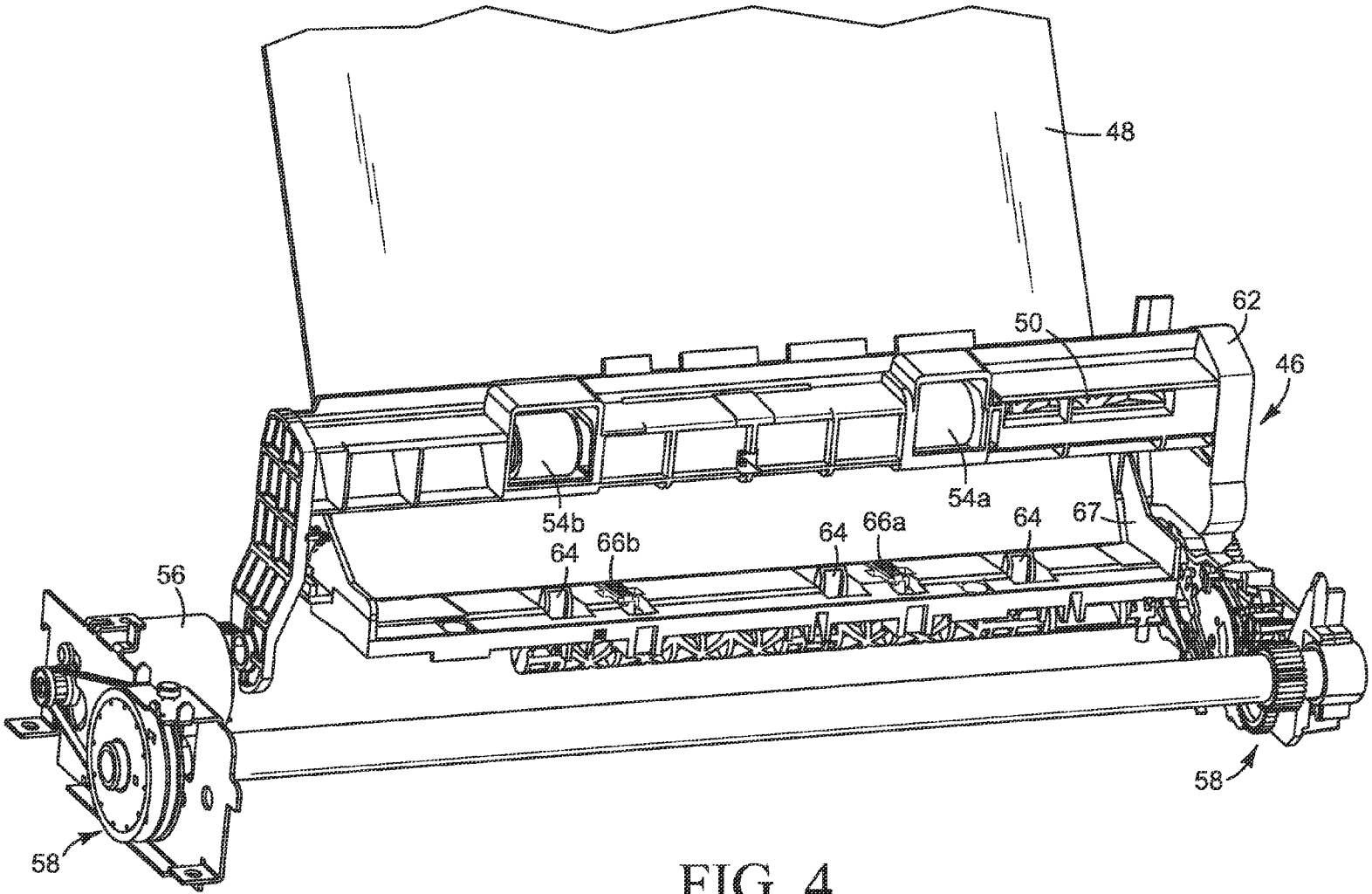
FIGS. 4 and 5 are perspective views illustrating one example of a print media pick/feed mechanism for the printer shown in FIGS. 2 and 3. The perspective of FIG. 4 is viewed from the front of the printer with a media stack. The perspective view of FIG. 5 is viewed from the rear of the printer without a media stack.
Figure 5:
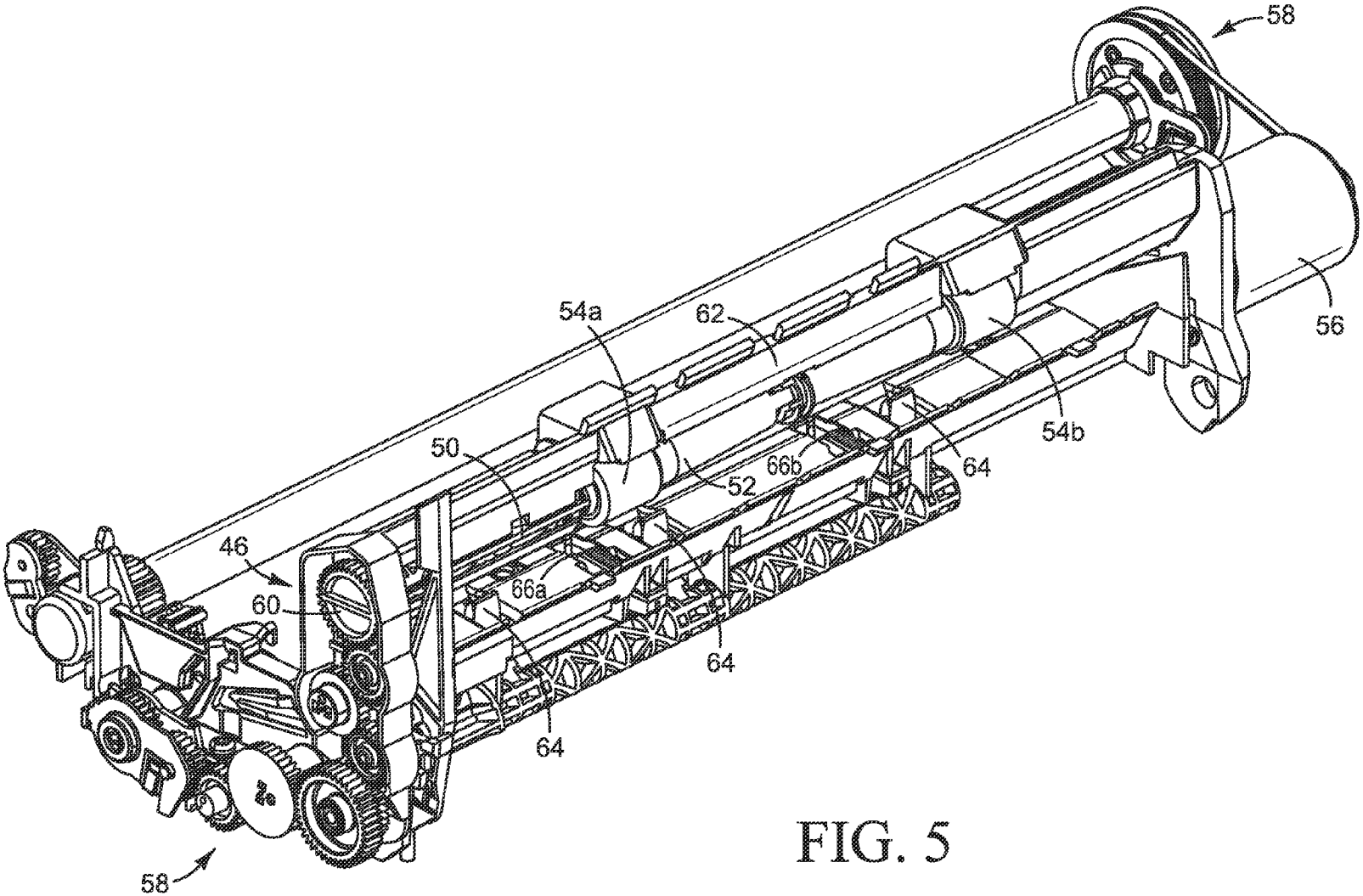

FIGS. 4 and 5 are perspective views illustrating one example of a print media pick/feed mechanism 46 for printer 10. The perspective of FIG. 4 is viewed from the front of printer 10 with a paper stack 48 and the perspective view of FIG. 5 is viewed from the rear of the printer without the paper stack 48. Referring to FIGS. 4 and 5, pick/feed mechanism 46 is used to pick the top sheet of paper from stack 48 and feed it into printer 10 toward a print zone where ink is applied. Pick/feed mechanism 46 includes a drive shaft 50, a hub 52 mounted to drive shaft 50, and a pair of pick tires 54*a* and 54*b* mounted to hub 52. Each pick tire 54*a* and 54*b* grips the top sheet of print media in the stack to pick the sheet from the stack and feed it into the printer. (Pick tires 54*a*, 54*b* rotating with hub 52 form input rollers 38 described above with reference to FIG. 3.) Drive shaft 50 and hub 52 are referred to collectively as drive shaft and hub assembly 53.

Drive shaft 50 is driven by a motor 56 through a drive train 58 that includes a gear 60 mounted on one end of drive shaft 50. Hub 52 is supported on a chassis 62 as described in detail below with reference to FIGS. 6 and 7. Pick/feed mechanism 46 also includes load stops 64 that prevent loading paper stack 48 too far into printer 10, a pair of sheet separator blocks 66*a* and 66*b* that help separate a top sheet from other sheets in stack 48 as the top sheet is fed into printer 10, and a registration wall 67 (FIG. 4). A movable width adjuster (not shown) is used to hold one edge of the paper close to registration wall 67 to help guide the paper straight into printer 10 during pick/feed operations.

Figure 6:
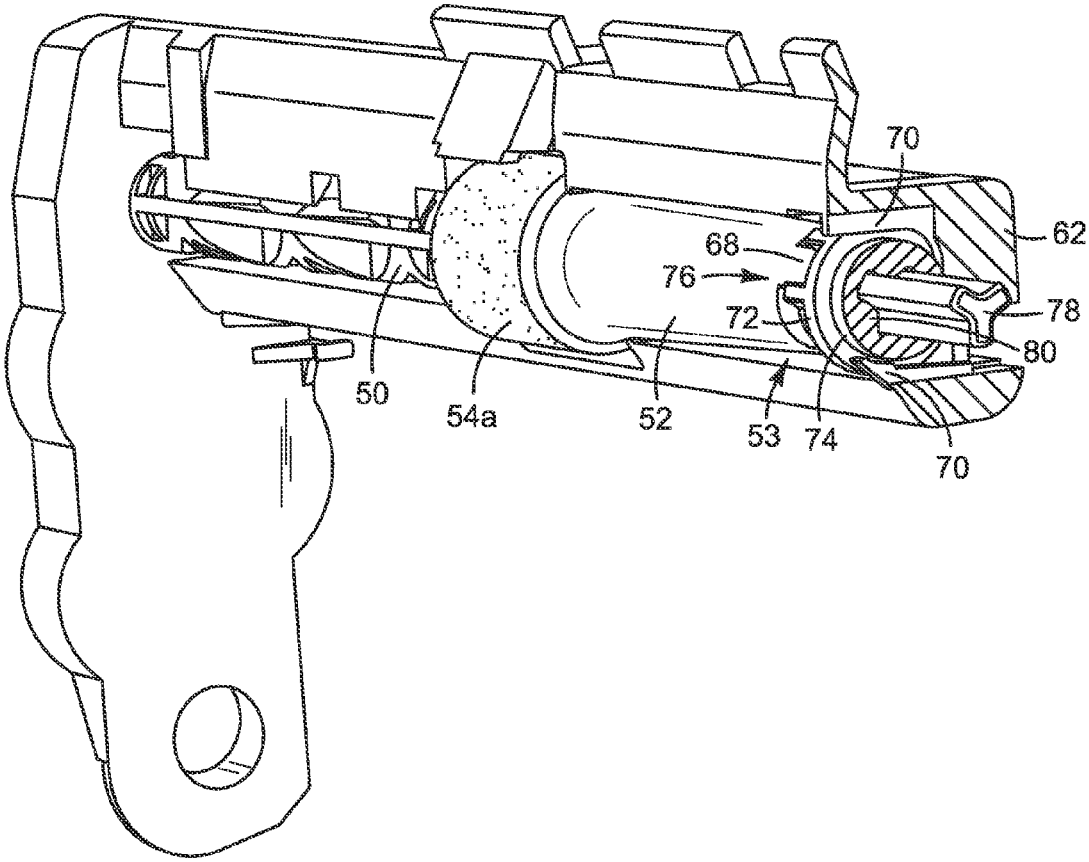
FIG. 6 is a detail perspective view of a portion of the pick/feed mechanism shown in FIGS. 4 and 5.
Figure 7:
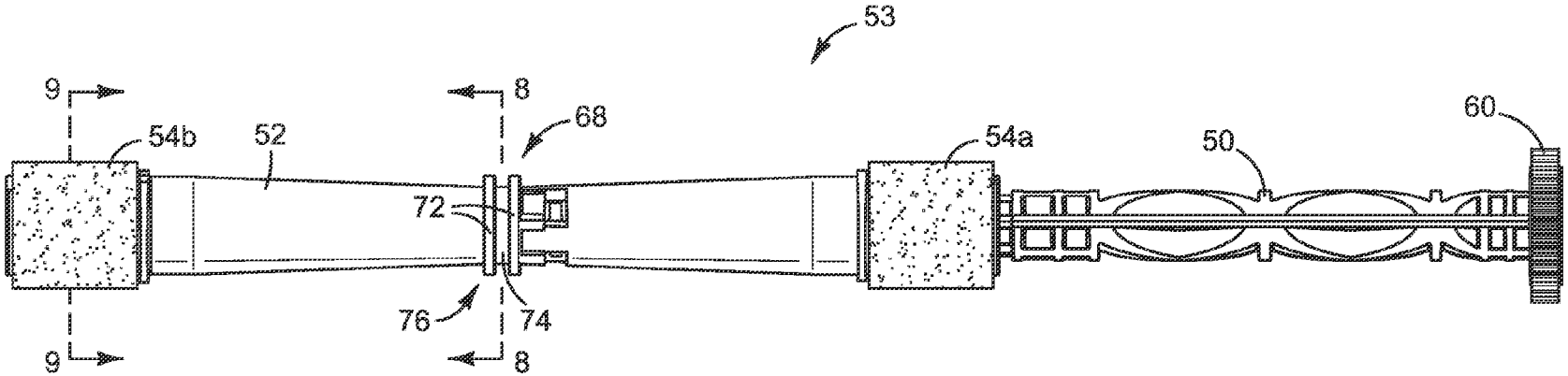
FIG. 7 is a detail elevation view of the drive shaft and hub assembly in the pick/feed mechanism shown in FIGS. 4 and 5.
Figure 9:
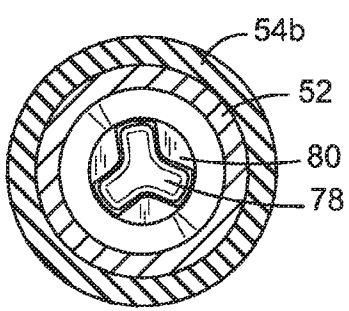
FIGS. 8 and 9 are section views of the drive shaft and hub assembly taken along the lines 8-8 and 9-9, respectively, in FIG. 7.
Figure 8:
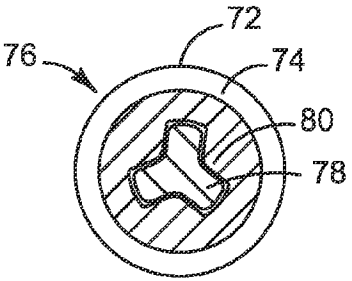
Figure 10:
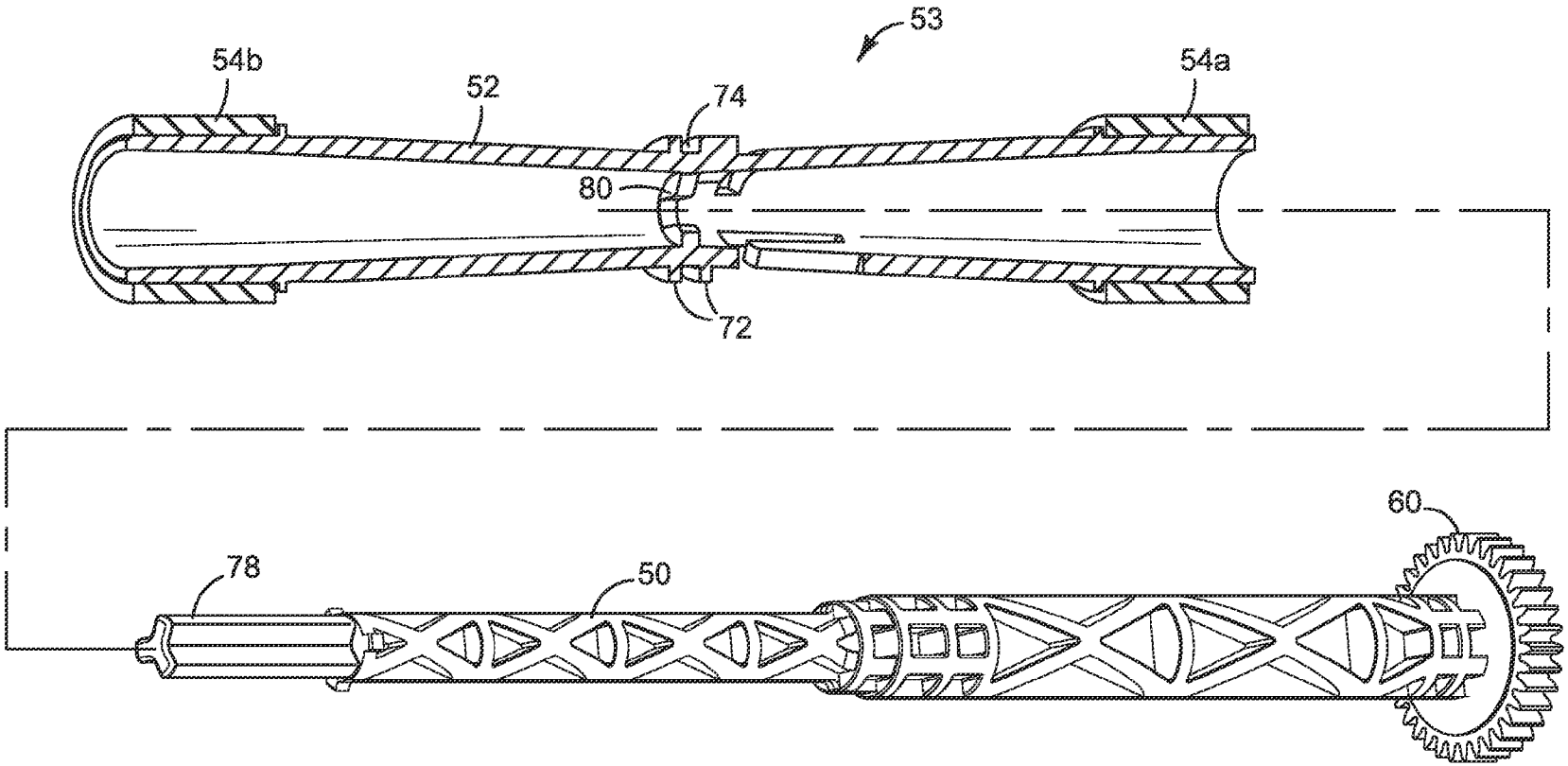
FIG. 10 is an exploded partial section view of the drive shaft and hub assembly shown in FIG. 7.
Figure 11:
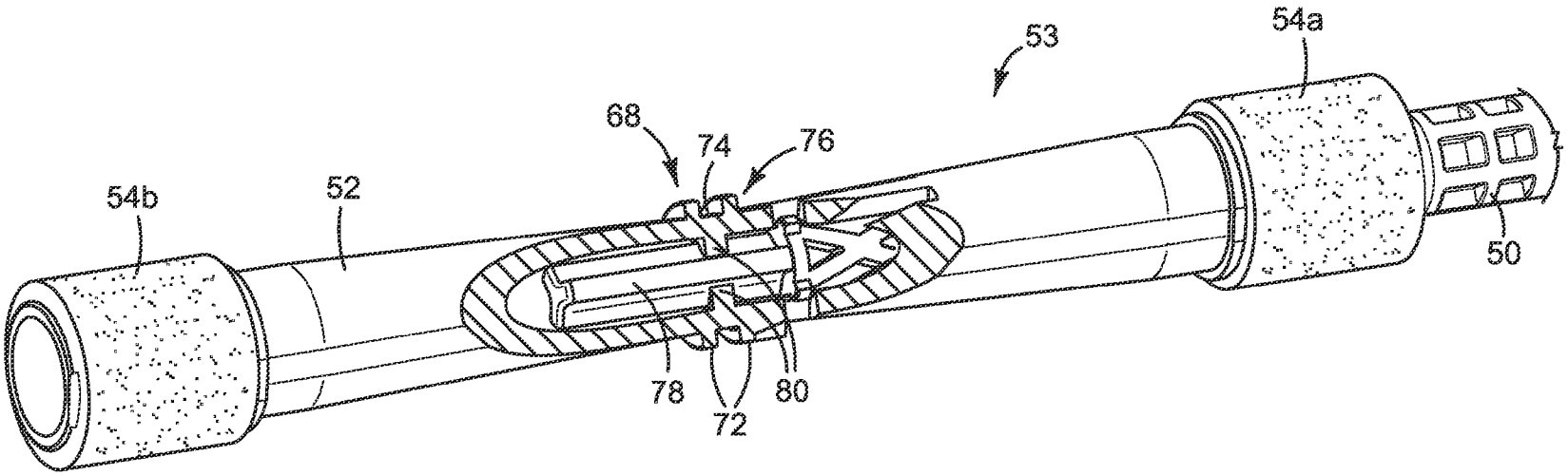
FIG. 11 is a perspective partial cut-away view of the drive shaft and hub assembly shown in FIG. 7.

FIG. 6 is a detail perspective view of a portion of pick/feed mechanism 46 and FIG. 7 is a detail elevation view of drive shaft and hub assembly 53. Referring to FIGS. 6 and 7, assembly 53 is supported by chassis 62 at the middle part 68 of hub 52. Chassis 62 is stationary with respect to hub 52. As shown in FIG. 6, a cradle 70 in chassis 62 cradles hub 52 at middle part 68 to support hub 52 while allowing hub 52 to rotate with drive shaft 50 and to tilt on drive shaft 50, as described below. Thus, cradle 70 acts both as a bearing surface on which hub 52 rotates during a pick/feed operation and as a pivot allowing 52 to tilt on drive shaft 50. In the embodiment shown, cradle 70 is configured as a flange or multiple flange parts that are thin in the lengthwise direction (parallel to axis of rotation 71 of drive shaft 50 in FIGS. 12 and 13). Hub 52 fits loosely in cradle 70 between a pair of rings 72 that define a recess 74 and constrain movement of hub 52 lengthwise along drive shaft 50. The loose fit and thin cradle 70 allows hub 52 to tilt on drive shaft 50.

Figure 12:
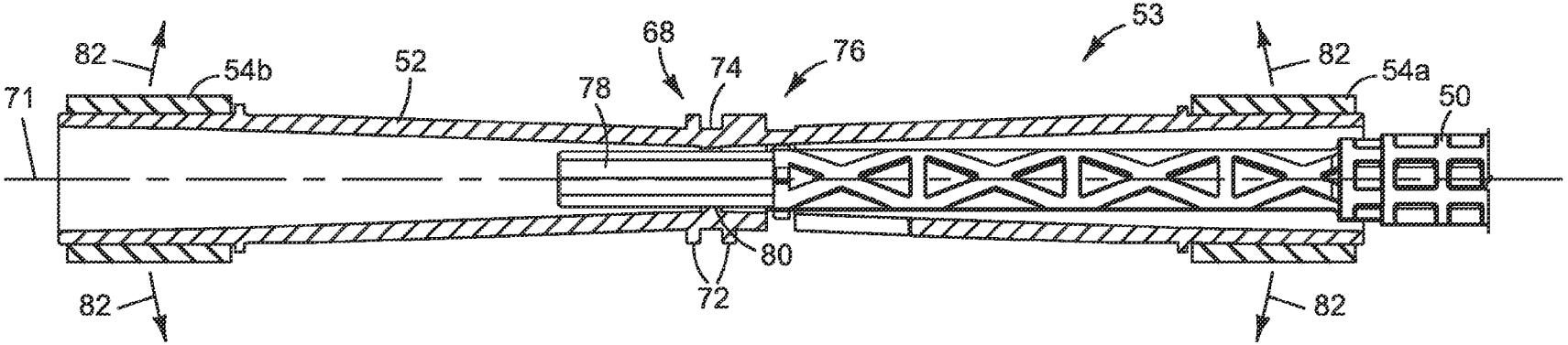
FIGS. 12 and 13 are partial section views of the drive shaft and hub assembly shown in FIG. 7.
Figure 13:
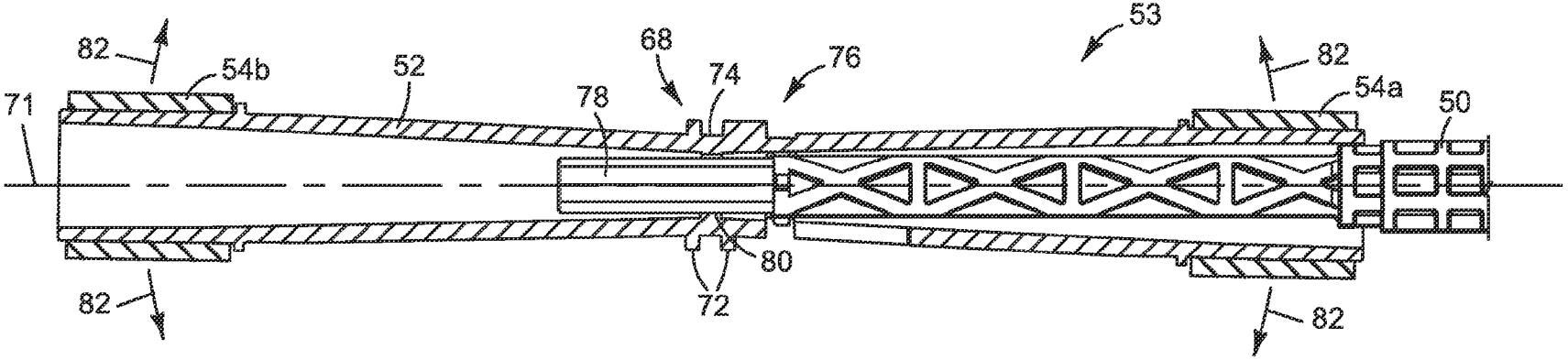

Referring now also to FIGS. 8-13, hub 52 is connected to drive shaft 50 at a connection 76 at hub center part 68. Connection 76 is configured to allow hub 52 to rotate with drive shaft 50 and to tilt on drive shaft 50. Connection 76 includes a spline end 78 on drive shaft 50 extending through a mating disc shaped coupler 80 on hub 52. In the embodiment shown, coupler 80 is configured as an annular protrusion with grooves matching the splines on shaft end 78. Spline shaft 78 fits loosely in coupler 80. Coupler 80 is thin in the lengthwise direction (parallel to the axis of rotation 71 of drive shaft 50 shown in FIGS. 12 and 13). The loose fit and thin coupler 80 allows hub 52 to tilt on drive shaft 50, as indicated by direction arrows 82 in FIGS. 12 and 13. In FIG. 12, hub 52 is straight on drive shaft 50. In FIG. 13, hub 52 is tilted on drive shaft 50. Thus, coupler 80 acts both as the operative connection for hub 52 to drive shaft 50 during a pick/feed operation and as a pivot allowing hub 52 to tilt on drive shaft 50. In the embodiment shown, connection 76 is aligned with recess 74 and cradle 70 so that hub 52 pivots in cradle 70 at the same location hub 52 is operatively connected to and pivots on drive shaft 50.

"Loose" and "thin" in this context mean there is sufficient separation between the parts to allow the desired degree of tilt without also negating the operative connection between the parts. In one example configuration that has been shown to work effectively, coupler 80 is 2 mm long (parallel to the axis of rotation 71 of drive shaft 50) with a 0.25 mm gap (on average) between the inside of coupler 80 and the outside of drive shaft spline end 78, allowing hub 52 to tilt at least 3° with respect to axis 71.

Figure 14:
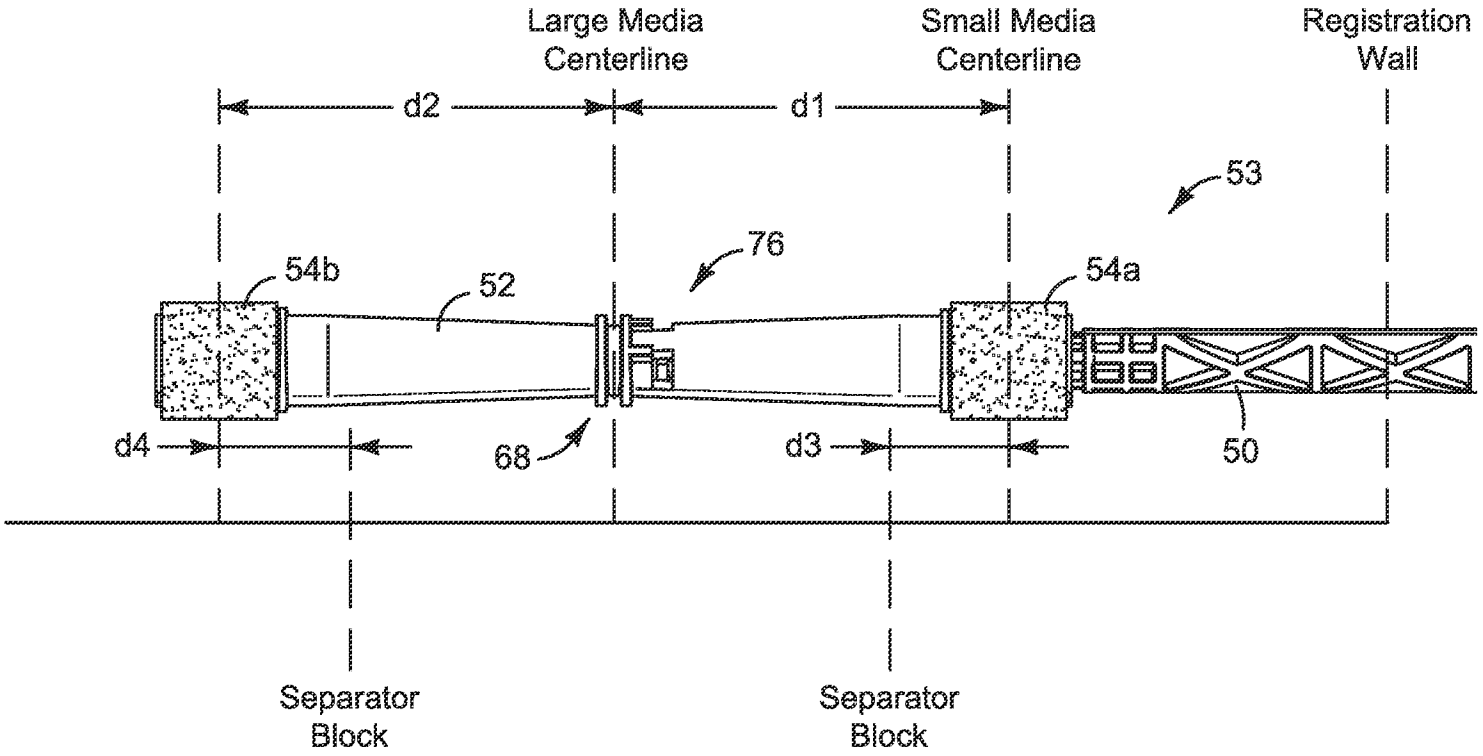
FIG. 14 is an elevation view illustrating one example configuration for the pick tires in the drive shaft and hub assembly shown in FIG. 7 relative to the registration wall and separation blocks in the pick/feed mechanism of FIGS. 4 and 5.

FIG. 14 is an elevation view illustrating one example configuration for positioning pick tires 54*a* and 54*b*. Referring to FIG. 14, pick tires 54*a* and 54*b* are spaced equally on either side of hub/shaft connection 76 (d1=d2 in FIG. 14) and connection 76 is located at the center of a larger size print media. Thus, pick tires 54*a* and 54*b* will engage the larger print media symmetrically about the centerline of the larger media. For example, if the most popular large print media is A4 size, then connection 76 is positioned 105 mm from the registration wall. This position for pick tires 54*a* and 54*b* helps feed the larger media symmetrically along registration wall 67 straight into the printer. Inside pick tire 54*a* is positioned a distance from the registration wall equal to one half the width of a smaller size print media. For example, if the most popular small media for printer 10 is 4"×6" color photo paper, then pick tire 54*a* is positioned 2" from the registration wall. This position for pick tire 54*a* helps feed the smaller media symmetrically along registration wall 67 straight into the printer.

Each pick tire 54*a* and 54*b* is spaced approximately equally from an adjacent separator block 66*a*, 66*b* (d3≈d4 in FIG. 14). The reaction force of separation block 66*a* (adjacent to pick tire 54*a*) on the leading edge of smaller print media when fed into the printer creates a moment relative to the force of pick tire 54*a* that drives the smaller media into registration wall 67 (FIG. 4). After the leading edge passes separator block 66*a*, pick tire 54*a* then drives the media straight along wall 67. As noted above, in the embodiment shown in FIG. 14, the spacing of pick tire 54*a* from registration wall 67 is determined by the centerline of a smaller media. In this embodiment, the spacing of separator block 66*a* from pick tire 54*a* (distance d3 in FIG. 14) is affected by the capacity of the smaller media to be driven against registration wall 67 without buckling. A larger distance d3 creates a greater force driving the top sheet into wall 67 but may result in the top sheet buckling. Thus, distance d3 is selected to create a sufficient moment to drive the top sheet into wall 67 but without also buckling the sheet. The distance d4 between pick tire 54*b* and separator block 66*b* is approximately equal to d3 to help maintain symmetry in feeding larger print media with both pick tires 54*a* and 54*b*.

To help deliver the normal force necessary to pick different size print media, hub 52 is allowed to pivot at its centerline to tilt with respect to the drive shaft axis or rotation 71. A tilt-able hub 52 reduces the influence of part variation on the symmetric contact of pick rollers 54*a* and 54*b* with the print media. Without the tilt-able hub, part variation could prevent the two pick tires 54*a*, 54*b* from contacting the media with equal force, thereby losing the benefits of positioning pick tires 54*a* and 54*b* symmetrically across the print media. In addition, equalizing the normal force exerted by each pick tire 54*a*, 54*b* lowers the overall normal force needed to help ensure a reliable pick/feed.

As noted at the beginning of this Description, the exemplary embodiment shown in the figures and described above illustrates but does not limit the disclosure. Other forms, details, and embodiments may be made and implemented. Therefore, the foregoing description should not be construed to limit the scope of the disclosure, which is defined in the following claims.

What is claimed is:

1. A device for moving print media in a printer, comprising:

a rotatable shaft extending lengthwise along an axis of rotation;

a hub directly and pivotally connected to the shaft at a connection such that the hub rotates with the shaft about the axis of rotation and so that the hub may tilt on the shaft relative to the axis of rotation;

a chassis directly supporting the hub at the connection so that the hub may rotate with the shaft and tilt on the shaft while supported by the chassis;

a first feature on the hub on a first side of the connection to move print media when the shaft rotates the hub; and a second feature on the hub on a second side of the connection opposite the first side to move print media when the shaft rotates the hub, wherein the chassis comprises a cradle loosely cradling the hub at the connection, the hub bearing on the cradle when it rotates with the shaft and pivoting on the cradle when it tilts on the shaft.

2. The device of claim 1, wherein the first feature and the second feature are positioned on the hub an equal distance from the connection.

3. The device of claim 2, further comprising first and second sheet separators to separate a top sheet moved from a stack of print media from next-to-top sheets in the stack and wherein each of the first feature and the second feature is positioned on the hub approximately an equal distance from a respective one of the separators.

4. The device of claim 1, further comprising a guide for abutting one edge of a sheet of print media when the print media is moved by the device, the first feature mounted on the hub a distance from the guide equal to one half the width of a first size of print media and the connection located a distance from the guide equal to one half the width of a second size of print media larger than the first size of print media.

5. The device of claim 1, wherein the first feature and the second feature each comprise a pick tire mounted to the hub.

6. The device of claim 1, wherein the connection comprises a spline part of the shaft loosely fitted into a mating disc shaped coupler on the hub.

7. A device for moving print media in a printer, comprising:

a rotatable shaft extending lengthwise along an axis of rotation;

a hub directly and pivotally connected to the shaft at a connection such that the hub rotates with the shaft about the axis of rotation and so that the hub may tilt on the shaft relative to the axis of rotation;

a chassis directly supporting the hub at the connection so that the hub may rotate with and tilt on the shaft while supported by the chassis, the chassis comprising a cradle loosely cradling the hub at the connection, the hub bearing on the cradle when the hub rotates with the shaft and pivoting on the cradle when the hub tilts on the shaft;

a first feature on the hub on a first side of the connection to move print media when the shaft rotates the hub;

a second feature on the hub on a second side of the connection opposite the first side to move print media when the shaft rotates the hub; and a guide for abutting one edge of a sheet of print media when the print media is moved by the device, the first feature and the second feature positioned on the hub an equal distance from the connection and the first feature mounted on the hub a distance from the guide equal to one half the width of a first size of print media.

8. The device of claim 7, wherein the connection is located a distance from the guide equal to one half the width of a second size of print media larger than the first size of print media.

9. A device for moving print media in a printer, comprising:

a rotatable shaft having a spline part;

a hub loosely coupled to the spline part of the shaft at a connection so that the hub may rotate with and tilt on the shaft;

a chassis directly supporting the hub at the connection so that the hub may rotate with and tilt on the shaft while supported by the chassis, the chassis comprising a cradle loosely cradling the hub at the connection so that the hub may tilt on the shaft while cradled by the chassis; and a feature on the hub to move print media when the shaft rotates the hub, wherein the hub bears on the cradle when rotating with the shaft and pivots on the cradle when tilting on the shaft.

10. The device of claim 9, wherein the feature comprises a pick tire.

11. The device of claim 9, wherein:

the hub is loosely coupled to the spline part of the shaft at a middle part of the hub surrounding the shaft;

the chassis loosely cradles the middle part of the hub; and the feature comprises a first feature on a first side of the middle part of the hub and a second feature on a second side of the middle part opposite the first side.

12. The device of claim 11, wherein the first feature and the second feature are positioned on the hub an equal distance from the middle part of the hub.

13. The device of claim 12, further comprising a guide for abutting one edge of a sheet of print media when the print media is moved by the device, the first feature mounted on the hub at a distance from the guide approximately equal to one half the width of a first size of print media and the hub coupled to the shaft at a distance from the guide equal to one half the width of a second size of print media larger than the first size.

14. The device of claim 11, wherein the first feature and the second feature each comprise a pick tire mounted to the hub.

* * * * *